US005494100A

United States Patent [19]

Peze

[11] Patent Number: 5,494,100

[45] Date of Patent: Feb. 27, 1996

[54] WELDED PLATE FIN HEAT EXCHANGER AND HEAT EXCHANGER PLATE FIN MANUFACTURING PROCESS

[76] Inventor: André Peze, 352 Allée Chatelard, 42155 Saint Leger sur Roanne, France

[21] Appl. No.: 107,726

[22] PCT Filed: Dec. 23, 1992

[86] PCT No.: PCT/FR92/01232

§ 371 Date: Aug. 20, 1993

§ 102(e) Date: Aug. 20, 1993

[87] PCT Pub. No.: WO93/13377

PCT Pub. Date: Jul. 8, 1993

[30] Foreign Application Priority Data

Dec. 23, 1991 [FR] France ..... 91 16423

[51] Int. Cl.[6] ..... F28F 3/14

[52] U.S. Cl. ..... 165/157; 165/166; 29/890.042

[58] Field of Search ..... 165/157, 166; 29/890.042

[56] References Cited

U.S. PATENT DOCUMENTS

| | | | |
|---|---|---|---|
| 2,456,455 | 12/1948 | Simpson | 165/157 |
| 2,690,002 | 9/1954 | Grenell | 29/890.042 |
| 2,941,787 | 6/1960 | Ramén | 165/157 |
| 3,129,756 | 4/1964 | Ramén | 165/157 |
| 4,688,631 | 8/1987 | Peze et al. | 165/166 |

FOREIGN PATENT DOCUMENTS

| | | | |
|---|---|---|---|
| 0186592 | 7/1986 | European Pat. Off. . | |
| 460872 | 12/1991 | European Pat. Off. | 29/890.042 |
| 1143037 | 9/1957 | France | 165/157 |
| 1443029 | 6/1966 | France . | |
| 1561819 | 3/1969 | France . | |
| 2204788 | 5/1974 | France . | |

OTHER PUBLICATIONS

Manufacturing Technology Note—U.S. Army Material Development and Readiness Command, Computer–Controlled Laser Welding, Jun. 1984.

JP 58128236, Patent Abstracts of Japan, Manufacture of Heat Collector.

*Primary Examiner*—Allen J. Flanigan

*Attorney, Agent, or Firm*—Eckert Seamans Cherin & Mellott

[57] ABSTRACT

The heat exchanger of the welded plate type is characterized in that it comprises and receives an assembly of a plurality of modules (M) comprised of two plates (5 and 6), said plates being interconnected by connection zones obtained by laser welding and shaped by hydroforming, said plates having their transversal extremities folded and defining between each other an internal longitudinal cavity forming a first fluid circulation conduit, said modules being associated with each other by connection of the folded extremities of the plates facing each other thereby defining, in a transversal plane, a second fluid air circuit (B).

11 Claims, 4 Drawing Sheets

WELDED PLATE FIN HEAT EXCHANGER AND HEAT EXCHANGER PLATE FIN MANUFACTURING PROCESS

The invention described herein addresses the field of heat exchanger and heat exchanger component engineering and construction.

Heat exchangers developed so far fall into two major categories: Tube heat exchangers and bonded or welded plate fin heat exchangers.

Heat exchangers of either type are manufactured by several manufacturers. Though satisfactory in operation, each design has certain major drawbacks limiting performance and reliability.

The efficiency of the tube heat exchanger is low. The design requires large areas of heat transfer surface to offset low heat transfer rates. In addition, tube heat exchangers are heavy, bulky and costly.

Bonded plate fin heat exchangers consist of stacked, shaped and ribbed plates arranged within top and bottom casing channels held together by tie-rods. Supply and return passages are created by stacking and bonding shaped plates. Such heat exchangers are compact and have good thermal performances. Their reliability, however, is a function of bonding and the temperature and pressure of the product carried. Also, other factors such as aging affect bond life.

Welded plate fin heat exchangers have the advantages and not the drawbacks of bonded plate fin heat exchangers, but are more expensive. Yet several design and manufacturing disadvantages remain, which are recognized by their manufacturers.

The first drawback, i.e., residual and other stresses, results from deep-drawing the plates to the required shape.

The second drawback, cavities, occurs where plates are bonded together or bonded to the fluid manifolds.

FIGS. 1 and 2 show deep-drawn plates (1–2) welded according to the prior art and where the welded areas (3) are liable to cavities. FIG. 3 shows pressure-induced distortion. It is found that distortion favors the formation of cavities (4) and is moreover inherent in the manufacturing process used: Plates are drawn first and welded next, favoring small stagnant chloride pools that cause corrosion, ultimately destroying stainless steel heat exchangers.

Expansion stress is a third drawback of plate fin heat exchangers.

In the case of parallelopipedic or cubical heat exchangers featuring welded twin-plate units stacked to create the core, stress caused by significantly different core top and bottom temperatures is taken up by a casing or box-like structure. The casing or box is subject to core homothetic temperatures differing as a function of casing gage. Temperature differences cause individual plates to expand at different rates, progressively causing casings or boxes to distort into truncated pyramid shapes. The core, then, is subject to temperature-induced stress on the one hand and stress caused by the deep-drawing process on the other.

In the case of self-supporting parallelopipedic heat exchanger cores with heavy-gage external top and bottom casing plates designed to take up pressure stresses and a core design featuring two outside walls integral to the self-supporting headers at either end, which, because they are only partly involved in the heat transfer process, take on temperatures differing from the other core plates— contact points are insufficient to ensure uniform temperatures between header walls because of the fact that the convection heat transfer rate is usually higher than the conduction heat transfer rate—which causes heavy stresses in the headers.

Such stresses can cause failure or leaks at the header or manifold welds.

A fourth drawback of the welded plate fin heat design is that such heat exchangers cannot be X-rayed or accessed completely. Certain supply and return parts cannot, therefore, be inspected, especially where the core is assembled to the casing.

The purpose of the invention is to overcome the drawbacks common to tube and welded plate fin heat exchangers described herein.

The object is to design a compact heat exchanger with the performances of the welded plate type and the reliability of the tube heat exchanger.

A further object is to design a heat exchanger free from the stresses caused by its manufacturing process.

A further object is to design a fully X-rayable, fully accessible heat exchanger.

A further object is to design a heat exchanger not liable to cavities between the plates or between the plates and the casing.

A further object is to design a high-pressure heat exchanger one of the circuits of which would be easy to clean.

The object of the present invention is apparent from the following description.

The welded plate heat exchanger is characterized, first of all, in that it is built up of modular cores consisting of two plates that are first laser-welded together and hydraulically expanded. Subsequently, short core module ends are cut and folded out at right angles to form flanges. The modules now constitute a longitudinal channel or passage open at both ends to carry a primary fluid A. When assembled side-by-side, a secondary fluid counterflow passage is created to carry a fluid B.

The invention is subsequently characterized in that individual core modules are assembled to form the heat exchanger core. The process consists of welding two plates together along perimeter lines and at certain points within these lines, subsequently creating a cavity between the plates by hydraulic expansion, while cutting the short ends of the module to create a passage for a primary fluid circuit. The short end edges are then folded back as flanges. Assembling the modules side-by-side creates a secondary fluid circuit.

These aspects and others will become apparent from the following description.

The object of the present invention is described, merely by way of example, in the accompanying drawings in which.

In order that the present invention may more readily be understood, the following description is given, merely by way of example, reference being made to the accompanying drawings.

It appears from the description of conventional plate fin heat exchangers that the manufacturing principle basically consists of first shaping the plate fins to weld them together at the appropriate spots after.

The invention is original in that the plates (5–6) to be incorporated into the heat exchanger are first welded together to constitute a core module (M), which is then expanded to create fluid passages.

Referring to FIGS. 4 through 11, it can be seen that the heat exchanger plate and heat exchanger manufacturing stages are:

First rectangular metal plates (5–6) of appropriate dimensions are made.

One plate is subsequently placed on top of the other.

The next stage consists of designing welding zones (7) between the plates to create a configuration that will meet heat transfer, fluid and pressure requirements, said zones constituting the lines along (7.1) or spots (7.2) at which the plates are laser-welded together. This process, requiring no weld metal, ensures welds are executed to geometrical specifications.

Figure 5:
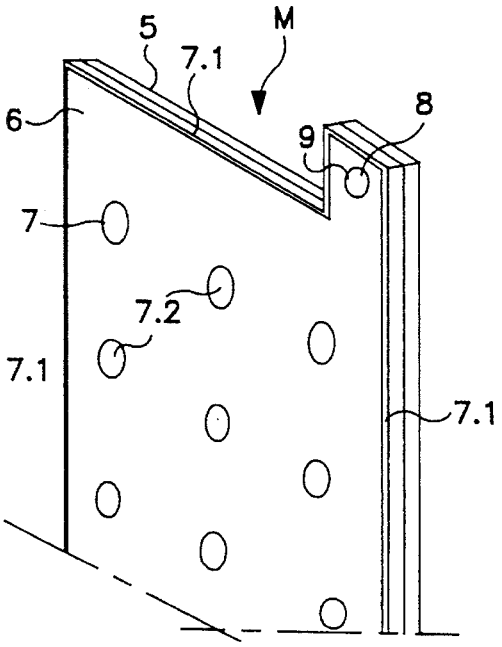
FIG. 5 is a schematic diagram showing the welding zones of two core module plates.

This done, the core module is welded along its perimeter to ensure a leak-tight construction, including the stud (8) containing a hydraulic fluid inlet opening (9) (FIG. 5).

The next stage consists of filling the core module with air, oil, water, or other suitable fluid through the inlet opening in the stud to cause a cavity between the plates that remain welded together at the perimeter and the inner spots throughout the hydraulic expansion operation.

Figure 1:
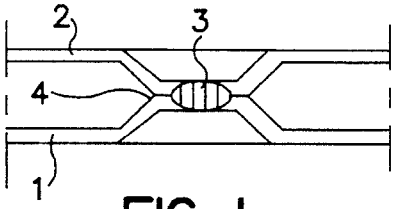
FIGS. 1, 2 and 3 are schematic diagrams showing the lines along which conventional heat exchanger plates are welded, indicating cavity spots.
Figure 2:
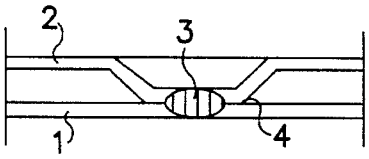
Figure 3:
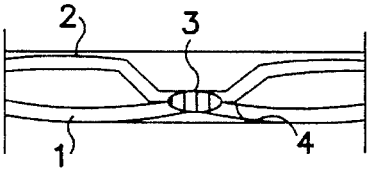
Figure 4:
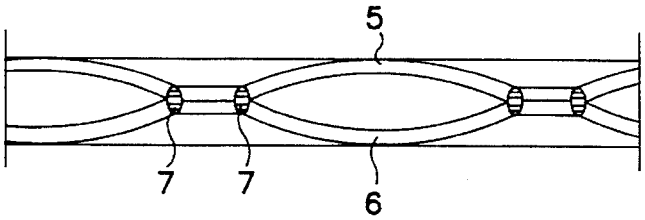
FIG. 4 is a schematic diagram of the manufacturing principle and the resulting heat exchanger core according to the invention.
Figure 6:
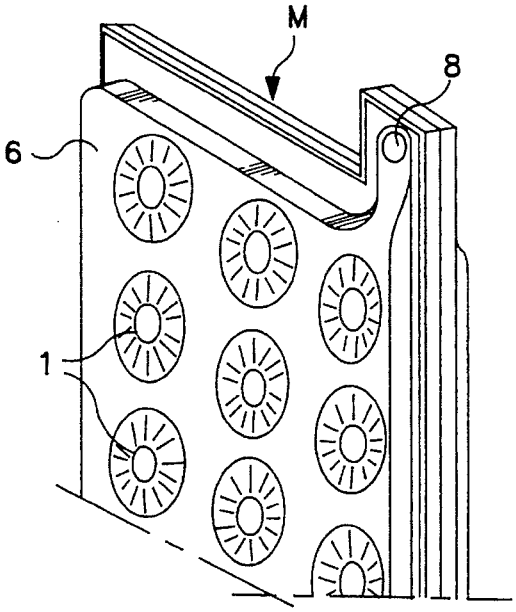
FIG. 6 shows how the two welded plates are hydraulically separated to constitute a fluid passage.
Figure 7:
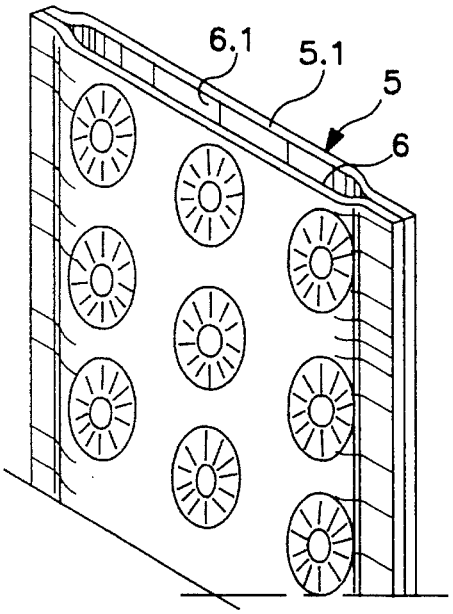
FIG. 7 is a sectional view of the core module with the short ends cut off.
Figure 8:
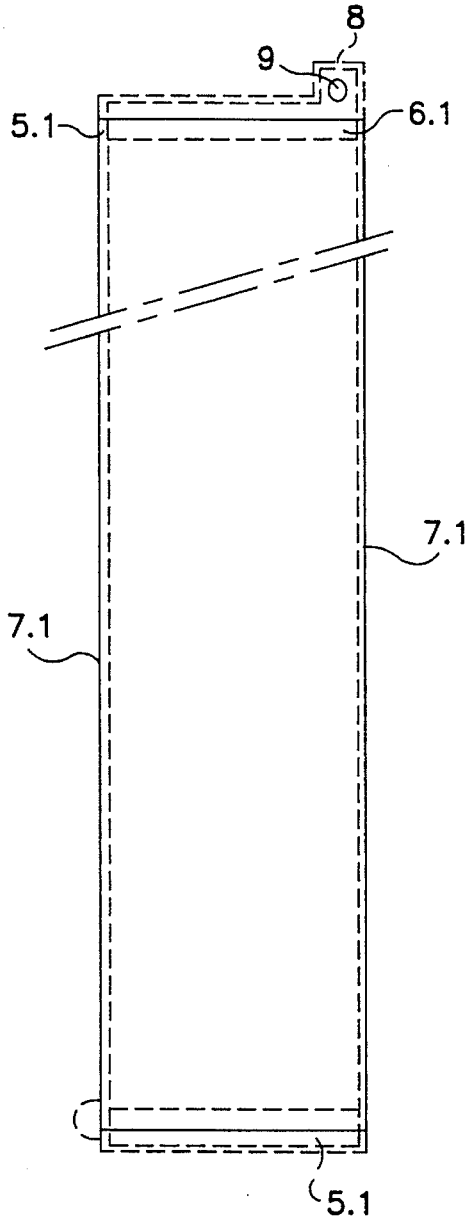
FIG. 8 is a front view of two welded plates prior to hydraulic expansion.

The configuration thus obtained is illustrated in FIGS. 4 and 6.

Figure 10:
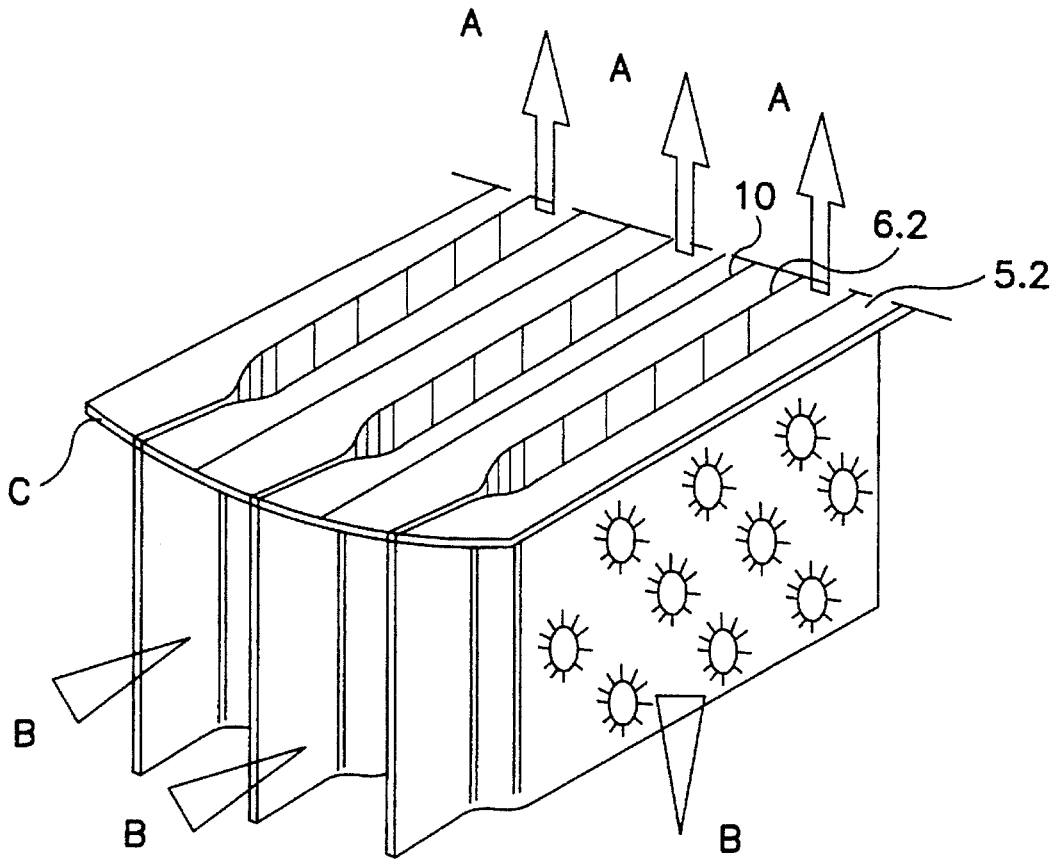
FIG. 10 shows the assembly of several core modules.

The next stage (FIG. 7) consists of removing the stud (8) containing the inlet opening (9), which is recovered, to subsequently cut each of the short ends (FIG. 8) along a line that will allow a C-type configuration to be obtained as shown in FIG. 10. The plates are then separated at the four corners.

Figure 9:
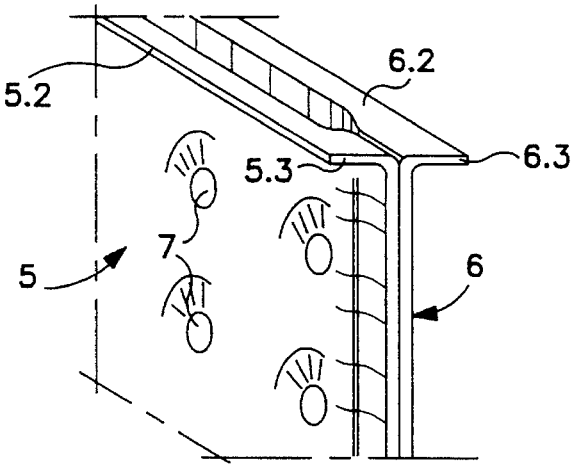
FIG. 9 is a schematic drawing of a core module according to FIG. 7 with the short end edges folded back to form flanges.

The next stage is illustrated in FIG. 9 and consists of folding the edges (5.2–6.2) of plates (5–6) constituting the core module at right angles. The flanges thus obtained (5.3–6.3) and the edge (6) are shaved and are used to weld the core modules side-by-side (FIG. 10), creating a secondary fluid circuit (B) that runs counterflow to primary circuit (A).

Figure 11:
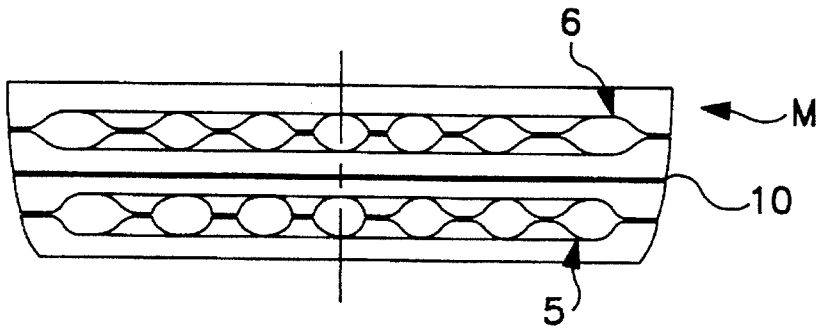
FIG. 11 is a top view showing two core modules assembled side-by-side.

As shown in FIGS. 10, 11 and onwards, the cores made up of the modules (M) consisting of plates (5–6) can then easily be incorporated in the cylindrical shell (E). To this end, the shape given the short ends (5.1–6.1, FIG. 8) of the core modules is such that, when all modules are assembled by juxtaposing the sectors (C), a circular core (C1) is obtained (C1) that matches the inner shape of the cylindrical shell.

Figure 12:
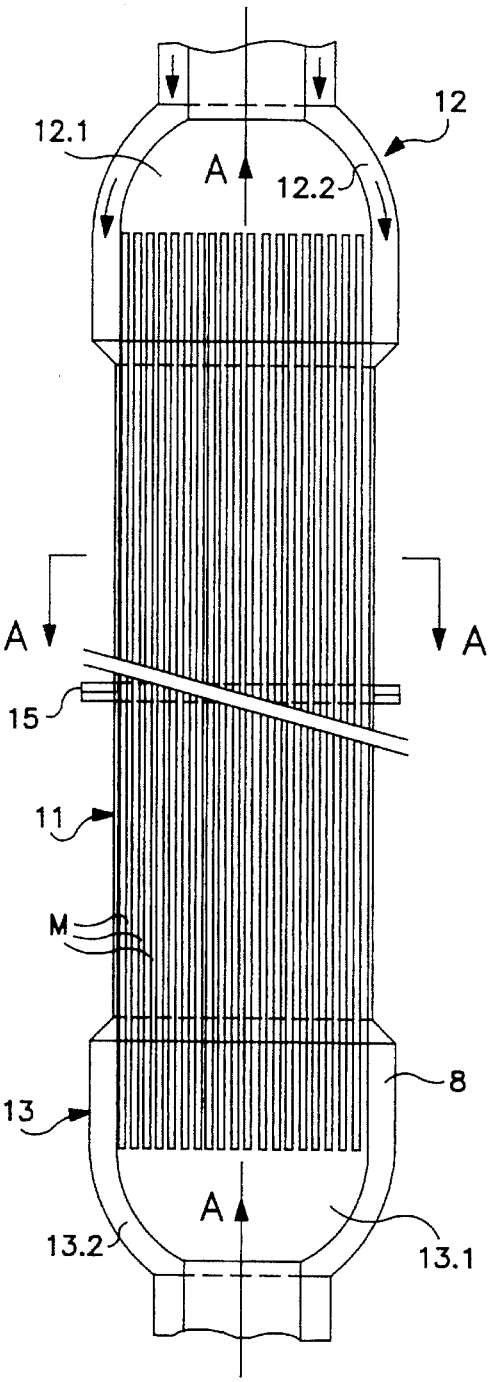
FIG. 12 is a cross-sectional view of a heat exchanger core assembled according to the invention.
Figure 13:
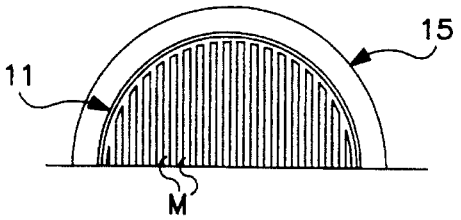
FIG. 13 is a transverse section along the line A—A of FIG. 12.
Figure 14:
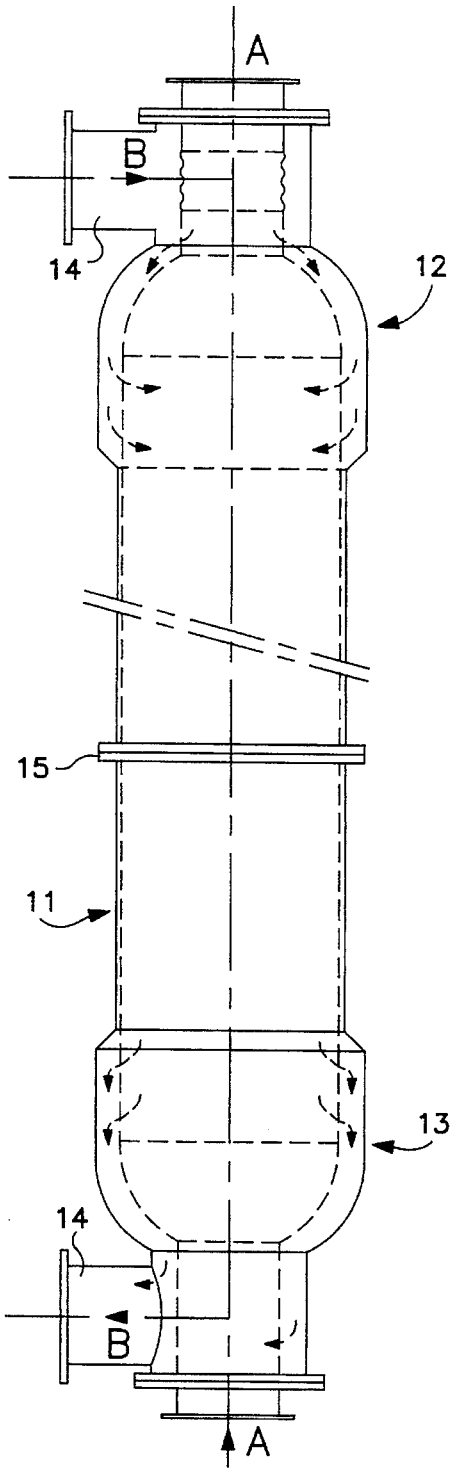
FIG. 14 is an exterior view of a heat exchanger designed and built according to the invention.

FIGS. 12, 13 and 14 show how the core modules (M) that are the subject matter of this invention, are arranged in the heat exchanger shell. The shell consists of a longitudinal body (11) of weldable metal in one or more sections assembled and held in place in relation to its supporting plane by the flange (15) or any other assembly method. The shell body is equipped with double preformed caps (12–13) at either end such as to constitute outer (12.1, 12.2) and inner chambers (13.1, 13.2) for primary fluid (A) and secondary fluid (B), respectively. The primary fluid, entering through inlet stub A, flows straight through the inner chamber and the heat exchanger core and exits through the opposite stub (A). The secondary fluid, entering the heat exchanger through inlet stub (B), passes through the outer chamber and running counterflow to primary fluid (A) in the heat exchanger core, exits through the outer chamber at the other end of the shell to leave the heat exchanger through the opposite stub B as shown in FIG. 10.

The benefits of the system invented are clear, as are the design characteristics of the heat exchanger, which combines the advantages of the conventional tube and the welded plate heat exchangers. Development objectives are all met.

This heat exchanger design is suitable for, amongst other applications, the petrochemical industry.

I claim:

1. A welded plate heat exchanger comprising a core of multiple twin-plate modules welded together, said plates being shaped and arranged to constitute primary fluid passages when placed end-to-end, short end edges of the modules being folded out at right angles to form flanges for use in welding the modules together side-by-side, thus constituting a channel designed to carry a secondary fluid;

wherein each of the transverse plate ends is shaped such that when the modules are assembled into a core, the plate ends constitute a circular flange matching the heat exchanger shell.

2. A heat exchanger as claimed in claim 1, wherein the ends of the two plates making up the module are folded into a horizontal position substantially at right angles to the longitudinal plane of each said plate, the flanges of consecutive modules thus formed being welded together end-to-end.

3. A welded plate heat exchanger comprising a core of multiple twin-plate modules welded together, said plates being shaped and arranged to constitute primary fluid passages when placed end-to-end, short end edges of the modules being folded out at right angles to form flanges for use in welding the modules together side-by-side, thus constituting a channel designed to carry a secondary fluid;

wherein said heat exchanger comprises a longitudinal shell designed to ultimately house a core of assembled twin-plate modules and being equipped at each of the ends with double preformed caps containing one inner chamber and one outer chamber, the inner chamber to carry a primary fluid and the outer chamber to carry a secondary fluid, with the primary fluid entering the heat exchanger at an inlet at one end to pass straight through the inner chamber along the primary fluid passages of the assembled modules to exit at an outlet after having passed the inner chamber at the opposite end, whereas the secondary fluid, entering the heat exchanger at an inlet, flows through the outer chamber and counter to the primary fluid, traverses the assembled core modules to exit through the outer chamber, leaving the heat exchanger at an outlet opposite to the respective inlet.

4. A heat exchanger as claimed in claim 3, wherein each of the transverse plate ends is shaped such that when the modules are assembled into a core, the plate ends constitute a circular flange matching the heat exchanger shell.

5. A welded plate heat exchanger manufacturing process wherein multiple twin-plate modules are constructed for assembly into a core designed to be incorporated into a heat exchanger shell, the process comprising laser-welding two plates together along predefined connecting weld lines around edges to obtain a leak-tight construction and at certain spots within a perimeter, with the plates being hydraulically separated to obtain inner passages in a second stage, transverse plate edges of each module being cut to open up a primary fluid circuit in a third stage, after which said transverse edges are shaped to permit assembly of the modules side-by-side to obtain a secondary fluid circuit.

6. A manufacturing process as claimed in claim 5, wherein the plates of each module are laser-welded together.

7. A manufacturing process as claimed in claim 5, wherein the plates initially include a protruding stub to be provided with a hydraulic fluid inlet opening, the plates having been welded together—in particular along the edges and at spots within a perimeter to obtain a leaktight construction—and subsequent hydraulic expansion, short welded ends being cut off, including the stub.

8. A manufacturing process as claimed in claim 5, wherein subsequent to cutting the short welded transverse ends and folding the remaining edges into flanges, said short ends are shaped into circular sections so that the modules, when assembled, form a circular heat exchanger core with an integral circular flange matching the heat exchanger shell interior.

9. A manufacturing process as claimed in claim 6, wherein the plates initially include a protruding stub provided with a hydraulic fluid inlet opening and in that, the plates having been welded together—in particular along the edges and at spots within the perimeter to obtain a leaktight construction—and subsequent hydraulic expansion, the short welded ends are cut off, including the stub.

10. A manufacturing process as claimed in claim 7, wherein subsequent to cutting the short welded transverse ends and folding the remaining edges into flanges, said short ends are shaped into circular sections so that the modules, when assembled, form a circular heat exchanger core with an integral circular flange matching the heat exchanger shell interior.

11. A manufacturing process as claimed in claim 9, wherein subsequent to cutting the short welded transverse ends and folding the remaining edges into flanges, said short ends are shaped into circular sections so that the modules, when assembled, form a circular heat exchanger core with an integral circular flange matching the heat exchanger shell interior.

* * * * *